US009011141B2

(12) United States Patent
Pillard

(10) Patent No.: US 9,011,141 B2
(45) Date of Patent: Apr. 21, 2015

(54) BURNER

(75) Inventor: Jean-Claude Pillard, Marseilles (FR)

(73) Assignee: EGCI Pillard, Cedex (FR)

( * ) Notice: Subject to any disclaimer, the term of this patent is extended or adjusted under 35 U.S.C. 154(b) by 1969 days.

(21) Appl. No.: 11/993,927

(22) PCT Filed: Jun. 26, 2006

(86) PCT No.: PCT/FR2006/001477

§ 371 (c)(1),
(2), (4) Date: Jul. 28, 2008

(87) PCT Pub. No.: WO2007/000512

PCT Pub. Date: Jan. 4, 2007

(65) Prior Publication Data

US 2009/0208889 A1 Aug. 20, 2009

(30) Foreign Application Priority Data

Jun. 27, 2005 (FR) ..... 05 06519

(51) Int. Cl.
*F23C 5/06* (2006.01)
*F23C 7/00* (2006.01)
*B01F 15/02* (2006.01)

(52) U.S. Cl.
CPC ..... *F23C 7/006* (2013.01); *F23C 7/004* (2013.01); *F23C 7/008* (2013.01)

(58) Field of Classification Search
CPC ..... F23C 7/006; F23C 7/004; F23C 7/002; F23C 5/06; F23C 2900/07001; B01F 15/00915
USPC ..... 431/354, 186, 182, 8, 9, 168, 169, 183, 431/187, 189
IPC ..... F23C 5/06; F01F 15/02
See application file for complete search history.

(56) References Cited

U.S. PATENT DOCUMENTS 1,344,029 A * 6/1920 Fischer ..... 431/186
2,368,178 A * 1/1945 Turpin ..... 239/417

(Continued)

FOREIGN PATENT DOCUMENTS

DE 197 38 054 A1 4/1998
EP 0 145 382 A 6/1985

(Continued)

OTHER PUBLICATIONS

DE_19738054_A1_I—MTrans.pdf, http://translationportal.epo.org, EPO Machine translation of DE_19738054_A1, Apr. 1, 2013.*

(Continued)

*Primary Examiner* — Gregory Huson
*Assistant Examiner* — Daniel E Namay
(74) *Attorney, Agent, or Firm* — Law Offices of Robert F. Zielinski, LLC

(57) ABSTRACT

The invention relates to a burner comprising several substantially concentric channels, one (1) of which is arranged outside of all fuel supply conduits and is delimited by two pipes (2,3), whose axes (4) are placed in a parallel position and which are movable with respect to each other. According to said invention, diverting members (6) used for imparting a tangential component (7) to a fluid flowing in the channel (1) are carried by the first pipe (2) and are fixed thereto, the second pipe (3) comprises a drive portion (9) for driving the fluid outside the diverting members (6) and the angle of tangential deviation of the fluid at the downstream end (8) of the channel (1) depends on the axial position of the second pipe (3) with respect to the first pipe (2).

12 Claims, 3 Drawing Sheets

(56) References Cited

U.S. PATENT DOCUMENTS

Figure 1:
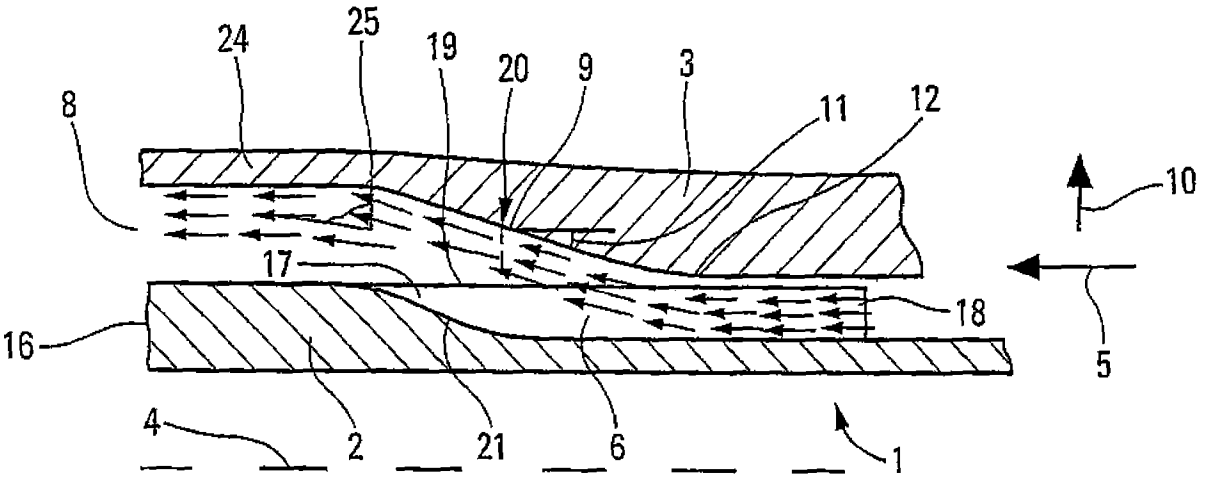

| | | | | |
|---|---|---|---|---|
| 2,793,686 | A * | 5/1957 | Phillips | 431/183 |
| 4,383,820 | A * | 5/1983 | Camacho | 431/8 |
| 5,199,355 | A * | 4/1993 | Larue | 110/261 |
| 5,231,937 | A * | 8/1993 | Kobayashi et al. | 110/262 |
| 5,292,244 | A * | 3/1994 | Xiong | 431/189 |
| 5,415,539 | A * | 5/1995 | Musil | 431/181 |
| 5,651,320 | A * | 7/1997 | Leisse et al. | 110/262 |
| 5,807,094 | A | 9/1998 | Sarv | |
| 6,315,551 | B1 * | 11/2001 | Salzsieder et al. | 431/183 |
| 6,389,998 | B2 * | 5/2002 | Mukai et al. | 110/347 |
| 6,715,432 | B2 * | 4/2004 | Tsumura et al. | 110/261 |
| 7,028,622 | B2 * | 4/2006 | Taylor | 110/265 |
| 7,267,809 | B2 * | 9/2007 | Ranke et al. | 423/449.1 |
| 7,367,798 | B2 * | 5/2008 | Sarv | 431/185 |
| 2001/0007233 | A1 * | 7/2001 | Mukai et al. | 110/347 |
| 2004/0194681 | A1 * | 10/2004 | Taylor | 110/261 |
| 2005/0120927 | A1 * | 6/2005 | Okazaki et al. | 110/261 |
| 2009/0208889 | A1 * | 8/2009 | Pillard | 431/182 |

FOREIGN PATENT DOCUMENTS

| | | | | |
|---|---|---|---|---|
| EP | 656509 | A1 * | 6/1995 | F23N 5/24 |
| EP | 0 836 048 | A1 | 4/1998 | |
| EP | 926435 | A1 * | 6/1999 | F23D 1/00 |
| EP | 0 945 678 | A2 | 9/1999 | |
| EP | 0 967 434 | A1 | 12/1999 | |
| EP | 1445535 | A1 * | 8/2004 | F23D 17/00 |
| FR | 777 246 | A | 2/1935 | |
| GB | 323 578 | A | 1/1930 | |
| WO | WO 2007000512 | A1 * | 1/2007 | F23C 7/00 |

OTHER PUBLICATIONS

"DE_19738054_A1_I—Google Trans.pdf", http://translate.google.com/, Google machine translation of DE_19738054_A1 , Apr. 1, 2013.*

* cited by examiner

BURNER

This invention relates to an annular duct as well as a burner including such a duct, with the burner being a primary air burner, a total air burner, a gas burner, etc.

An annular duct of the type delimited by two pipes whose axes are parallel and which are axially mobile in relation to one another is known in the art, with a first pipe carrying diverting members used for imparting a tangential component to a fluid flowing in the duct.

Such a duct is frequently used in burners, particularly in primary air burners such as those described in application EP 967 434. Indeed, in modern burners such as those described in this application, in order to improve combustion, the fuel supply ducts are surrounded by two peripheral primary air supply ducts generating a vortex (or helical) flow, with one of these ducts not comprising diverting members in such a way that the air circulating therein exits therefrom according to an axial flow, while the other comprises such members in such a way that the air circulating therein exits therefrom according to a rotational flow around the axis of the burner. The quality of the improvement delivered by these two peripheral ducts depends on the adjustments that need to be made, especially concerning the flows of primary air that they deliver: on the one hand the total flow of air delivered by these two peripheral ducts in relation to the flows of the other constituents (fuel and central primary air), and, on the other hand, the relationship of these two flows of peripheral primary air which allows the vortex effect to be modulated. Adjusting the two flows is particularly delicate and requires that the user be particularly qualified.

In addition, due to the presence of the two peripheral air supply ducts, these burners are particularly heavy, voluminous, complex (on the portion upstream of the ducts in order to allow them to be supplied) and expensive.

Moreover, these burners have a relatively substantial charge loss since the peripheral primary air rubs against four walls (two per duct).

A first solution consisted in suppressing the peripheral primary air supply duct with axial flow. However, in this case, it is no longer possible to adjust the magnitude of the tangential component of the vortex flow.

A second solution consisted in improving the first solution by breaking down the single peripheral primary air supply duct into a section upstream (without diverting member), a section downstream (without diverting member) and flexible ducts arranged between the two sections and distributed regularly around the axis of the burner. A relative rotation of the two sections drives a torsion of the flexible ducts which thus makes it possible to impart a tangential component of a greater or lesser degree to the fluid exiting the downstream section. The main problem with this solution relates to the flexible ducts which are mobile and which can be deformed in a hot area, which are subject to wear and tear and to breaking, especially when the air circulating is charged with dust.

This invention aims to realise, on the one hand, a burner that offers the same possibility of adjusting the vortex flow as burners having two peripheral air supply ducts, without having the aforementioned inconveniences, and, on the other hand, an annular duct making it possible to have such a burner.

According to the invention, in the annular duct of the aforementioned type, the second pipe is shaped in such a way that the angle of tangential deviation of the fluid at the downstream end of the duct depends on the axial position of the second pipe in relation to the first one.

As such, according to the invention, for a given flow of air circulating in the duct, it is possible to modify the tangential component of the fluid via a simple relative axial displacement of the two pipes, without the duct comprising any mobile elements in relation to these two pipes. In addition, the axial mobility of the two pipes does not have the inconveniences of the flexible pipes proposed in prior art.

Other particularities and advantages shall appear in the detailed description of embodiment given by way of non exhaustive example and shown in the annexed drawings.

Figure 2:
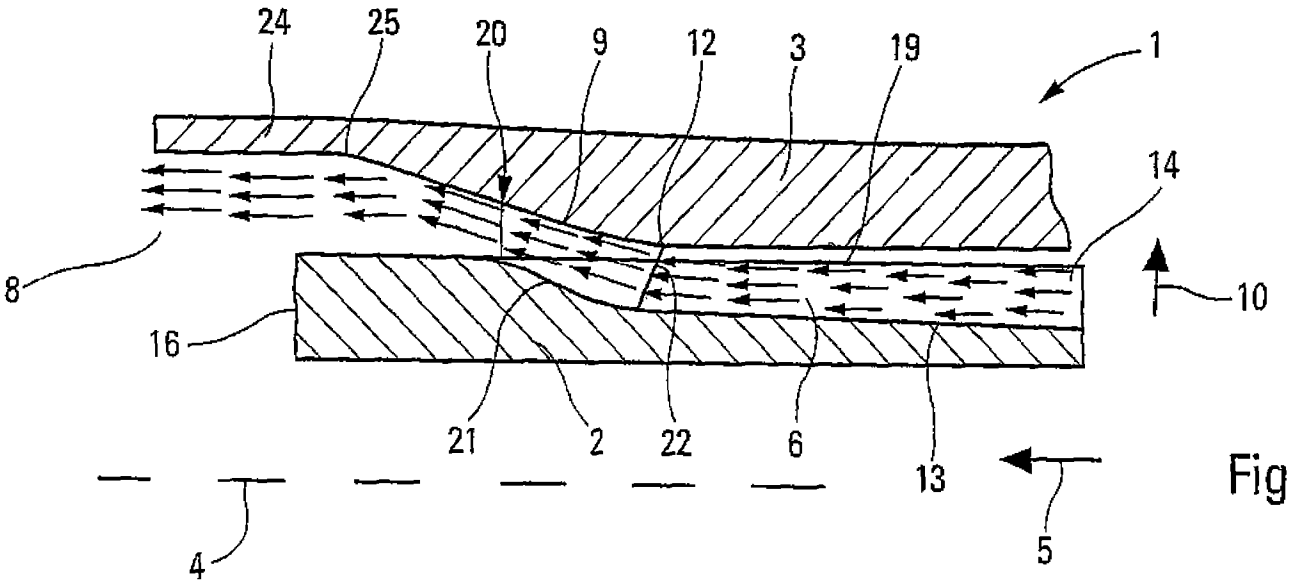
Figure 3:
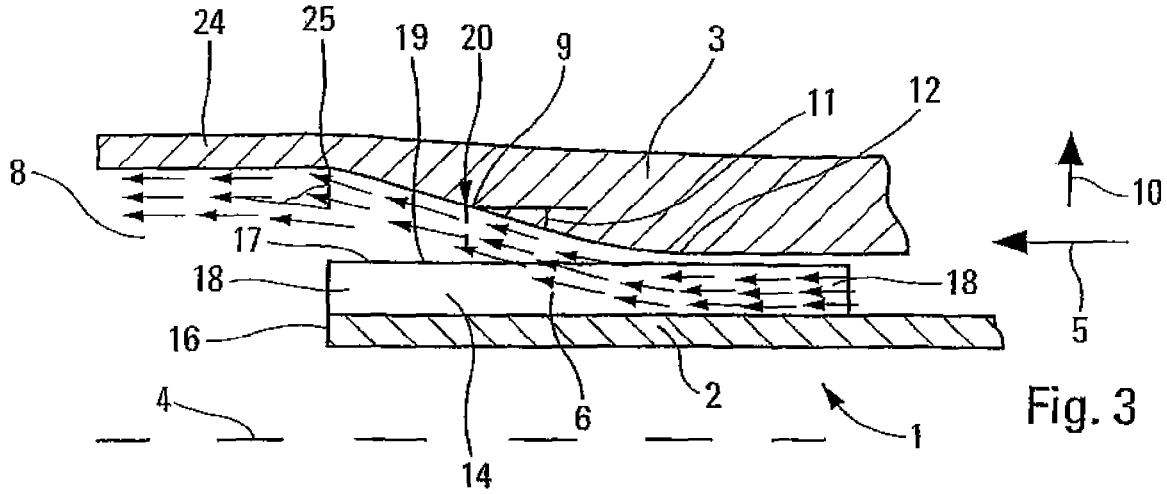
Figure 4:
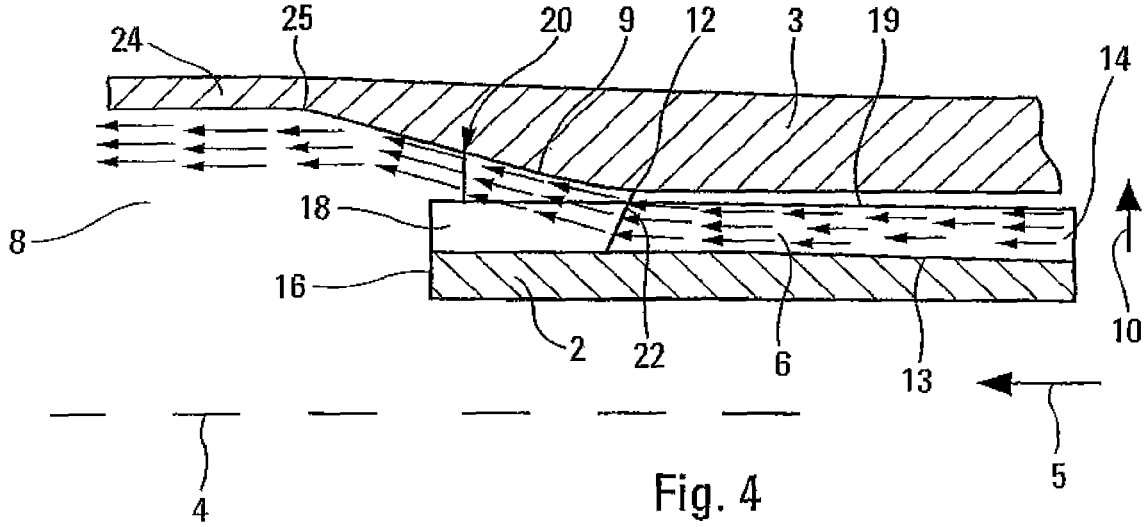
Figure 5:
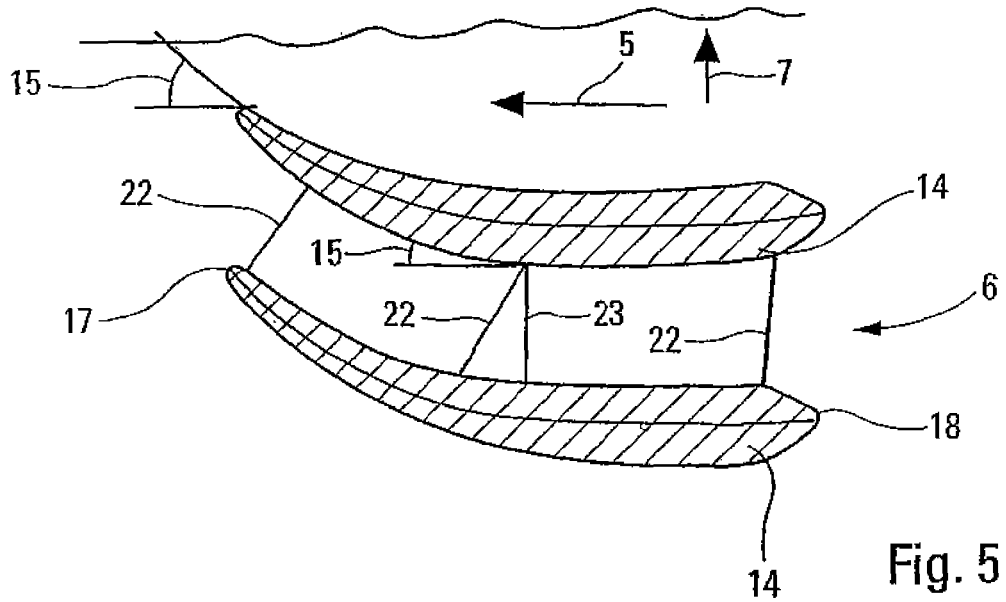
Figure 6:
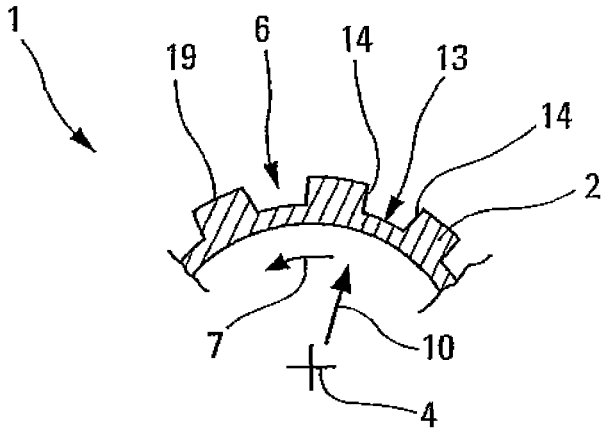
Figure 7:
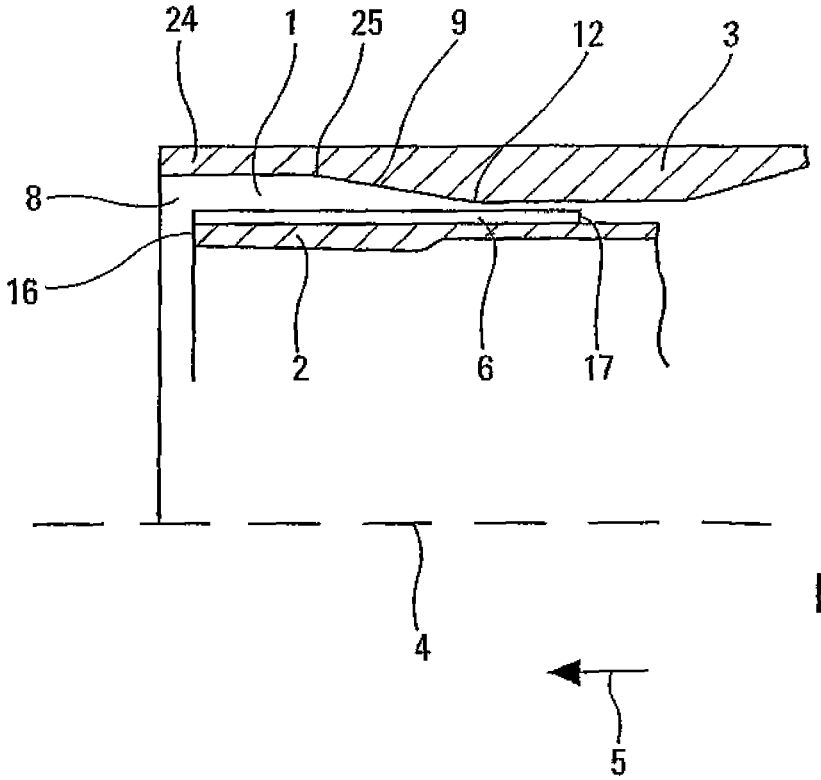

FIG. 1 is an axial cross-section view of the downstream portion of the duct in accordance with a first embodiment of this invention, the first pipe being in an advanced position, FIG. 2 is a view similar to FIG. 1, the first pipe being in a retracted position, FIG. 3 is a view similar to FIG. 1, of a duct in accordance with a second embodiment of this invention, FIG. 4 is a view similar to FIG. 3, the first pipe being in a retracted position, FIG. 5 is an unrolled view of the downstream portion of the first pipe, FIG. 6 is a partial axial cross-section view of a portion of the first pipe and diverting members, and FIG. 7 is a partial view along an axial cross-section of a burner comprising an annular duct in accordance with the second embodiment of this invention.

An annular duct 1 in accordance with this invention is delimited by two pipes 2, 3 whose axes 4 are parallel (here, the two pipes 2, 3 are coaxial) and which are mobile along axial direction 5 in relation to one another.

A first pipe 2 (here internal pipe 2) carries diverting members 6 which are used to impart a component according to tangential direction 7 to a fluid flowing in the duct. Second pipe 3 (here external pipe 3) is shaped in such a way that the angle of tangential deviation of the fluid at the downstream end 8 of duct 1 depends on the axial position of second pipe 3 in relation to the first pipe 2.

As can be seen in FIGS. 1 and 2, in these examples, second pipe 3 includes a drive portion 9 for driving the fluid outside the diverting members 6, and thus allowing the fluid to have at the downstream end 6 of duct 1 substantially the same tangential deviation as when it exits diverting members 6. The modification of the angle of tangential deviation of the fluid is accomplished by the axial displacement of drive portion 9 in relation to diverting members 6.

Drive portion 9 is oriented, according to the radial direction 10, in the sense of an increase in the distance from the first pipe 2 for a displacement according to the axial direction 5 from upstream towards downstream (due to the fact that the second pipe 3 is the external pipe, the drive portion 9 is divergent). Here, drive portion 9 is a conical portion 9.

In these embodiments, the modification of the angle of tangential deviation of the fluid is facilitated via application of the Coanda effect. More precisely, second pipe 3 is shaped so as to allow for clinging of the streams of fluid against the wall therein via the Coanda effect. In order to be able to use this effect, in these embodiments, half-angle 11 at the apex of the cone is less than 15°. Therefore, starting from the upstream end 12 of drive portion 9, the fluid follows the wall of second pipe 3 and, in terms of its orientation, frees itself from diverting members 6 of first pipe 2. As such, according to the axial position of the upstream end 12 of drive portion 9 in relation to diverting members 6, the fluid acquires a tangential component of a greater or lesser degree.

Diverting members 6 are affixed in relation to the first pipe 2 and, in this case, are formed by channels 6 produced by machining (for example, by milling) of first pipe 2. This pipe can include, for example between 8 and 36 channels 6.

Each channel 6 is delimited by a base wall 13 and by two longitudinal walls 14. Base wall 13 extends along the axial 5 and tangential 7 directions and, for this reason, is of cylindrical form. The two longitudinal walls 14 extend along the axial 5 and radial 10 directions and they have a tangential deviation 15 in relation to axis 4 of first pipe 2, as shown in FIG. 3.

In order to obtain a fluid at the output of duct 1 having good vortex behaviour in the case where it is used in a burner, for each channel 6, at any point in axial direction 5, the angle of tangential deviation is less than 45°.

In order to obtain a wide amplitude of tangential flow at the output of duct 1, for each channel 6, the angle of tangential deviation 15 at a point taken along axial direction 5 varies according to the distance of this point from the downstream end 16 of first pipe 2. And more precisely, for each channel 6, angle of tangential deviation 15 increases from the upstream end 17 of channel 6 to the downstream end is thereof. Therefore, according to the position of drive portion 9 in relation channel 6, it is possible to very simply modify the tangential component of the fluid at the exit of the duct, the more this fluid is freed from channels 6 upstream, the lower its tangential component is (and corresponds to angle of tangential deviation 15 of channel 6 at the axial point where the fluid exits therefrom (with channel 6 being "open" in the direction of second pipe 3). In addition, by configuring each channel 6 in such a way that its angle of tangential deviation 15 is zero (or substantially zero) at its upstream end 17, it is possible to obtain, a fluid with axial flow at the exit of duct 1.

As shown in FIGS. 1 to 4, longitudinal walls 14 have, in radial direction 10 a dimension such that their free radial end 19 does not rub against second pipe 3. As such, the radial distance between free radial end 19 of longitudinal walls 14 and the portion 20 of the second pipe 3 upstream of the upstream end 12 of drive portion 9 is at least equal to 0.5 mm.

It is understood that, due to the application of the Coanda effect, regardless of the relative axial position of the two pipes 2,3, starting from the upstream end 12 of drive portion 9, with regards to the portion of the fluid until then ducted (the portion of the fluid which upstream from the upstream end 12 of drive portion 9, was between the longitudinal walls 14), a portion (the portion closest to free radial end 19) frees itself from channel 6, and this portion becomes greater and greater as the fluid flows along drive portion 9, until reaching an axial point of release 20 where substantially all of the portion of the fluid until then ducted when the radial distance separating drive portion 9 from free radial end 19 reaches the radial dimension of longitudinal walls 14.

Consequently, the portion of channels 6 which is downstream of the axial point of release 20 is unused (for a given relative axial position of the two pipes 2, 3).

In the first example shown in FIGS. 1 and 2, for each channel 6, base surface 13 has, a downstream end portion 21 oriented, according to radial direction 10, in the sense of a reduction in the distance of the second pipe 3 for a displacement according to the axial direction 5 from upstream moving downstream. Here, this orientation is such that at the downstream end 18 of channels 6, base wall 13 reaches the free radial end 19 of longitudinal walls 14 in such a way that the radial dimension of the longitudinal walls therein is zero.

In the second example shown in FIGS. 3 and 4, each channel 6 exits at the downstream end 16 of first pipe 2 (which is thus also the downstream end 18 of channels 6), as shown moreover in FIG. 7.

Moreover, the radial distance between the free radial end 19 of longitudinal walls 14 and the portion 20 of the second pipe 3 upstream of the upstream end 12 of drive portion 9 can be relatively large (in absolute terms, for example at least equal to 10 mm, as well as relative to the radial dimension of the longitudinal walls). Therefore, it is possible to obtain a portion of the fluid for which the flow is axial at the exit of duct 1, regardless of the relative axial position of the two pipes 2, 3. This portion is that which has not been dusted (or which has been ducted on the axial portion of channels 6 of which the angle of tangential deviation 15 is zero), i.e. the portion of the fluid which upstream of the upstream end 12 of drive portion 9, was between the second pipe 3 and the free radial end 19 of longitudinal walls 14.

In addition, due to the variation of the angle of tangential deviation 15 along the axis 4 of first pipe 2, if the spacing between the two longitudinal walls 14 of a channel 6 is constant across the entire length of channel 6, the flow of fluid at the exit of channels 6 varies according to the relative axial position of the two pipes 2, 3 (according to the angle of tangential deviation 15 at the exit of channel 6). So, in order to obtain constant flow regardless of the relative axial position of the two pipes 2,3, as is shown in FIG. 5, each channel 6 is configured in such a way that the spacing between its two longitudinal walls 14 at a point taken according to the axis 4 of the first pipe 2, varies according to angle of tangential deviation 15 at this point in such a way to obtain a substantially constant useful section 22 at the exit of channel 6 at the upstream end 12 of drive portion 9. Useful section 22 being equal to the product of cross section 23 by the cosine of angle of tangential deviation 15.

Furthermore, in order to obtain at the output of duct 1 a flow that does not deviate in relation to the axis 4 of duct 1 (here the second pipe 3 being the external pipe, so that the flow is not divergent), second pipe 3 includes a cylindrical portion 24 extending the downstream end 25 of drive portion 9. Preferably, so that this portion has a sufficient straightening effect, its length is at least greater than three times the distance separating the two pipes 2,3 on this downstream cylindrical portion 24.

Such a duct 1 can be incorporated into any burner including several substantially concentric ducts due to the fact that it makes it possible to be able to very easily vary the tangential component of the fluid at the exit according to the relative axial position of the two pipes 2, 3 delimiting this duct 1, and this variation being able to not cause any flow variation in the case where diverting members 6 are in a configuration suitable for this.

The burner can by of the partial air type. It can for example include at least four substantially coaxial ducts, these four ducts including a central fuel supply duct, a central primary air supply duct surrounding the central fuel supply duct, a peripheral fuel supply duct surrounding central primary air supply duct, and a primary air supply annular duct in accordance with this invention located to the exterior of all the fuel supply ducts, the burner comprising a central stabiliser which covers the output of the central primary air supply duct, and which comprises openings through which the primary air exits coming from the central primary air supply duct. This burner corresponds to that described in application EP 967 434, the duct in accordance with this invention replacing the two external ducts.

It can also include at least four substantially coaxial ducts, these four ducts including a central fuel supply duct, a pulverised solid fuel supply annular duct surrounding the central fuel supply duct, a central primary air supply annular duct surrounding the pulverised solid fuel supply duct, and a peripheral primary air supply annular duct in accordance with this invention which surrounds the central primary air supply annular duct, the burner comprising a central stabiliser, placed at the output of the central primary air supply annular duct, and which comprises openings through which the primary air exits coming from the central primary air supply duct. This burner thus corresponds to that described in application EP 1 445 535, the duct in accordance with this invention replacing the two external ducts.

The burner can also be of the total air type, with the primary air supply annular duct in accordance with this invention being surrounded by at least one secondary air supply duct.

The burner can also be of the gas type including at least two substantially coaxial ducts, these two ducts including one peripheral gas supply annular duct in accordance with this invention that surrounds the other duct.

This invention is not limited to the previously described embodiment.

It would therefore be possible for the first pipe (the one carrying the diverting members) to be the external pipe, with the second pipe then being the internal pipe.

It would be possible for the channels to be produced by affixing longitudinal walls (for example via welding) to the first pipe.

The invention claimed is:

1. A burner comprising:

a plurality of substantially concentric ducts comprising:

fuel supply ducts, and an additional duct, in which another fluid flows, located at the exterior of the fuel supply ducts, the additional duct being delimited by a first pipe and a second pipe whose axes are parallel and which are mobile in relation to one another along an axial direction;

diverting members defined in the additional duct by channels supplied with the other fluid and used to impart a tangential component to the other fluid, the diverting members being fixedly carried by the first pipe and the diverting members being open in the direction of the second pipe, the second pipe including a drive portion to drive from upstream towards downstream the other fluid outside the diverting members according to an angle of a tangential component at a downstream end of the additional duct which depends on axial position of the second pipe in relation to the first pipe, the drive portion being oriented, according to a radial direction, defined as an increase in a distance from the first pipe for a displacement according to the axial direction from upstream towards downstream.

2. The burner according to claim 1, wherein the second pipe is shaped so as to allow for clinging of the streams of fluid against a wall thereof via the Coanda effect.

3. The burner according to claim 1, wherein the drive portion is a conical portion having an apex and a half-angle at said apex which is less than 15°.

4. The burner according to claim 1, further comprising a downstream end.

5. The burner according to claim 4, wherein for each channel, the angle of tangential deviation is substantially zero at the upstream end thereof.

6. The burner according to claim 4, wherein for each channel, the base surface of its downstream end portion is oriented, according to radial direction, in the sense of a reduction in the distance of the second pipe for a displacement according to the axial direction from upstream moving downstream.

7. The burner according to claim 1, wherein the diverting members are defined by channels each of which is delimited by a base wall and two longitudinal walls which respectively extend along the axial direction and a direction radial thereto and have a tangential deviation, in relation to the axis of the first pipe.

8. The burner according to claim 4 or 7, wherein for each channel, the angle of tangential deviation increases from the upstream end of channel to the downstream end thereof.

9. The burner according to claim 1, wherein for each channel, at any point along axial direction, the angle of tangential deviation is less than 45°.

10. The burner according to claim 1, wherein each channel exits at a downstream end of the first pipe.

11. The burner according to claim 1, wherein for the portion of the channels upstream of the upstream end of the drive portion, the radial dimension of longitudinal walls is such that their free radial end is at a distance between 0.5 and 10 mm from second pipe.

12. The burner according to claim 1, wherein for each channel, the spacing between the two longitudinal walls at a point varies according to the angle of tangential deviation at this point so as to obtain a useful section at the exit of channel at the upstream end of drive portion that is substantially constant regardless of the relative axial position of the two pipes.

* * * * *